US008464881B2

(12) United States Patent
Rieskamp

(10) Patent No.: US 8,464,881 B2
(45) Date of Patent: Jun. 18, 2013

(54) COUPLING DEVICE FOR A CART, AND RAIL-GUIDED CART WITH A COUPLING DEVICE

(76) Inventor: Gerhard Rieskamp, Munich (DE)

( * ) Notice: Subject to any disclaimer, the term of this patent is extended or adjusted under 35 U.S.C. 154(b) by 0 days.

(21) Appl. No.: 13/534,159

(22) Filed: Jun. 27, 2012

(65) Prior Publication Data

US 2012/0326818 A1 Dec. 27, 2012

Related U.S. Application Data

(60) Provisional application No. 61/501,313, filed on Jun. 27, 2011.

(51) Int. Cl.
*A63H 19/18* (2006.01)

(52) U.S. Cl.
USPC ..... 213/75 TC; 213/75 R

(58) Field of Classification Search
USPC ..... 213/75 TC, 75 R, 211, 212; 446/444, 446/465, 138
See application file for complete search history.

(56) References Cited

U.S. PATENT DOCUMENTS

| | | | | |
|---|---|---|---|---|
| 2,939,245 | A * | 6/1960 | Orel | 446/138 |
| 3,330,066 | A * | 7/1967 | Crawford | 446/138 |
| 3,469,713 | A * | 9/1969 | Edwards et al. | 213/75 TC |
| 3,564,766 | A * | 2/1971 | Edwards et al. | 213/75 TC |
| 3,850,310 | A * | 11/1974 | Osthall | 213/75 TC |
| 5,048,704 | A * | 9/1991 | Takahashi | 213/75 D |
| 5,427,561 | A * | 6/1995 | Eichhorn et al. | 446/463 |
| 5,509,546 | A * | 4/1996 | Staat | 213/75 TC |
| 5,681,202 | A * | 10/1997 | Sander | 446/138 |
| 5,775,525 | A * | 7/1998 | Brill | 213/75 TC |
| 6,352,463 | B2 * | 3/2002 | Forkman | 446/138 |
| 6,379,213 | B2 * | 4/2002 | Whitworth | 446/444 |
| 6,722,941 | B2 * | 4/2004 | Dowd et al. | 446/465 |
| 6,896,574 | B2 * | 5/2005 | Needham et al. | 446/138 |
| 7,080,745 | B2 * | 7/2006 | Senften | 213/75 TC |
| 7,293,671 | B2 * | 11/2007 | Senften | 213/75 D |

FOREIGN PATENT DOCUMENTS

| | | |
|---|---|---|
| CN | 201 735 181 U | 2/2011 |
| DE | 2112422 A | 10/1972 |
| DE | 29621610 U1 | 3/1997 |

* cited by examiner

*Primary Examiner* — Jason C Smith
(74) *Attorney, Agent, or Firm* — Sughrue Mion, PLLC

(57) ABSTRACT

A coupling device for coupling two cars includes a coupling body, a bearing with which the coupling body is mounted to pivot about a vertical axis of the car, and a drawbar via which the coupling body is fastened on the bearing and held at a distance to the bearing. The coupling body has on its side facing away from the bearing at least two convex contact spines adjacent to one another and each lying in a plane parallel to the vertical axis of the car whose diameters of curvature are greater than the extension of the contact spines in the direction of the vertical axis and by which at least one of the contact spines is magnetized, so that two of the cars couple by magnetic attraction on contact of the contact spines of the first car with the contact spines of the second car.

17 Claims, 2 Drawing Sheets

COUPLING DEVICE FOR A CART, AND RAIL-GUIDED CART WITH A COUPLING DEVICE

Figure 1:
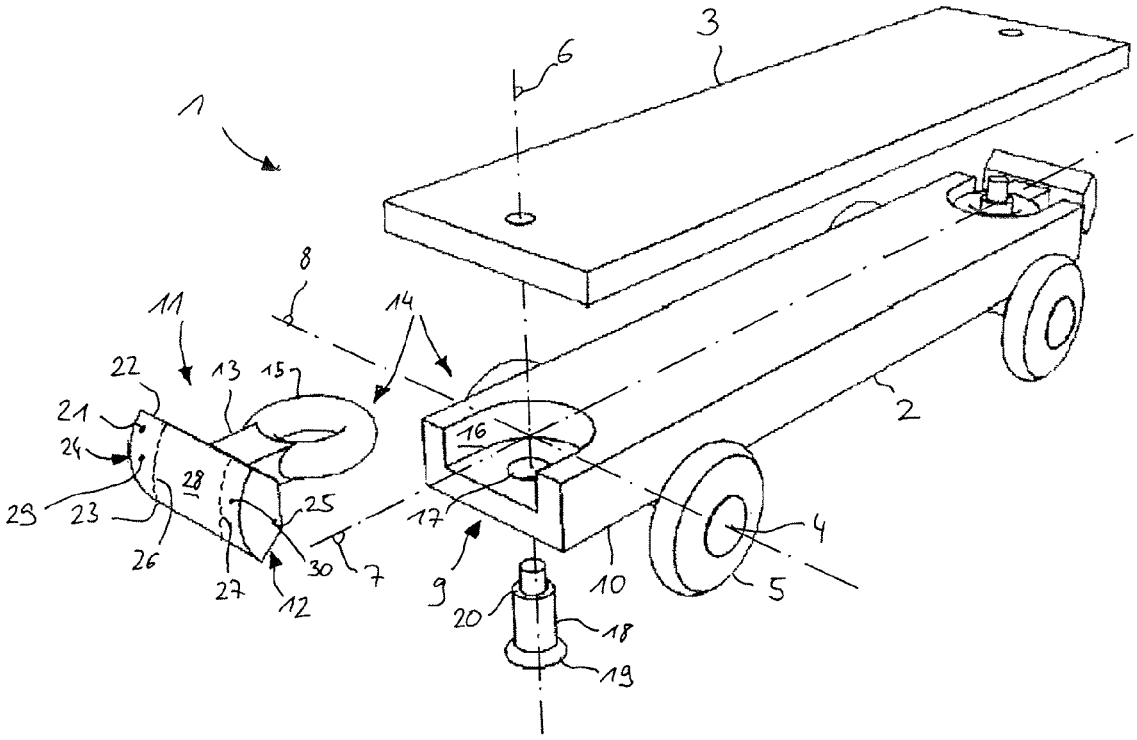

The present application claims priority to U.S. Provisional Application No. 61/501,313 with a filing date of Jun. 27, 2011, the entire disclosure of which is incorporated herein by reference.

The invention concerns a coupling device for a car and a car which comprises the coupling device and is rail-guided.

On the coupling of rail-guided cars, in particular of cars of a toy train, great demands with respect to kinematics and handleability are placed. Known is a coupling which is constructed from permanent magnets and to each of whose coupling halves one of the cars is affixed, wherein two permanent magnets disposed opposite one another and with unequal magnetic poles face one another so that through the magnetic attraction of the two coupling halves during their physical contact the coupling of the cars is effected. However, it is disadvantageous therein that in coupling the cars attention must be paid to an appropriately unequal magnetic pole pairing, whereby the flexibility in assembling a train of cars is affected. Furthermore, the magnetic coupling has little lateral mobility, whereby the running of the train of cars through narrow curves is only possible to a limited extent.

It is desirable that the magnetic coupling halves are identical in construction and are thus compatible so that the cars can be coupled to one another independently of their orientation with respect to the direction of travel. Furthermore, it is desirable that with the train of cars sharp curves, in particular S-curves, and grades with a steep slope can be overcome. Furthermore, it is desirable in the use of the magnetic coupling in the toy train that the magnetic coupling is appropriate for children and is accordingly simple in its operation. Along with this the magnetic coupling should be designed so that no parts detach from it, which, for example, can be swallowed by a child, or have sharp breaking edges on which a child could injure himself.

It is an object of the invention to provide a coupling device for a car and a car which is rail-guided and comprises the coupling device, where the coupling device is simple in construction and in handling and enables secure coupling of the cars, in particular when running through narrow curves and steep grades.

The inventive coupling device for a car for coupling two of the cars comprises a coupling body, a bearing with which the coupling body is mounted so that it can pivot about a vertical axis of the car, and a drawbar via which the coupling body is fastened to the bearing and held at a distance from the bearing, where the coupling body comprises on its side facing away from the bearing at least two convex contact spines which lie next to one another and are each in a plane parallel to the vertical axis of the car whose diameters of curvature are greater than the extension of the contact spines in the direction of the vertical axis of the car and by which at least one of the contact spines is magnetized so that two of the cars can be coupled by magnetic attraction on contact of the contact spines of the first car with the contact spines of the second car. According to the invention the car comprises the coupling device and is rail-guided.

It is preferable that the projections of the contact spines in the direction of the horizontal axis of the car are of the same form and congruent. The contact spines are preferably formed raised. As an alternative thereto the coupling body's side facing away from the bearing comprises a convex contact face into which the contact spines are integrated in such a way that the contact spines lie flush in the contact face. That is, the contact face is curved about the horizontal axis of the car in the manner of a can, where the contact spines are defined by the magnetization on the contact face. Preferably on each of the contact spines a magnetic pole is formed, whereby two of the cars can be coupled by the magnetic attraction on contact of the contact spines of the first car with the contact spines of the second car.

It is preferable that the contact face is a surface segment of a straight circular cylinder whose axis is perpendicular to the vertical axis of the car. The contact face with its contact spines is preferably formed smooth so that two coupling devices coupled with one another can roll up on their contact faces and/or slip against one another in the directions of the vertical axis of the car.

The coupling body preferably comprises two contact spines and is preferably formed as a bar magnet whose first magnetic pole is established on one of the contact spines and whose second magnetic pole is established on the other contact spine. The magnetic poles are disposed at the end-face longitudinal ends of the bar magnet, where preferably the contact spines can coincide with an end-face boundary edge of the contact face.

The coupling body preferably alternatively comprises two contact spines with each being made of a ferromagnetic material and being ferromagnetically insulated from the other, where one of the contact spines is magnetized and the other contact spine is not magnetized. Here the coupling body preferably comprises an intermediate area which is disposed between the contact spines and is made of a non-ferromagnetic material, in particular plastic or aluminum, whereby the contact spines are magnetically insulated from one another by the intermediate area. Furthermore, both contact spines are preferably alternatively of a ferromagnetic material and magnetized, where the two contact spines are ferromagnetically insulated from one another and the arrangement of the magnetic poles on the contact spines is in the opposite sense to one another.

Preferably the bearing is arranged in such a way that the coupling body can be pivoted about the horizontal axis of the car. Here the bearing preferably comprises a bearing ring and a bearing bolt which when mounted on the car extends through the bearing ring with a play sufficiently great that the bearing ring can be tilted for pivoting the coupling body on the bearing bolt. Preferably the bearing furthermore comprises a recess in the car which is dimensioned in such a way that the bearing ring can be inserted into the recess with a play sufficiently great that the bearing ring can be tilted for pivoting the coupling body on the bearing bolt. The bearing ring preferably has a circular cross section. Thus the bearing ring is preferably formed in the manner of a torus.

Furthermore, it is preferable that the car is a toy train car. It is also preferable that the car is provided in a conveyance-technology device, for example, in a car-based transport system for a high rack storage area.

With the coupling device the mobility of two cars coupled with the coupling device is defined. In particular, with the coupling device turning about the vertical axis of the car and turning about the horizontal axis of the car is enabled. During running of the cars on curves it comes to a point that their longitudinal ends veer out and the cars' longitudinal ends lying opposite one another are displaced laterally relative to one another. During running of the cars through valleys and hills with steep slopes the two longitudinal ends lying opposite one another are, when passing the bottoms of the valleys and the tops of the hills, displaced in the vertical direction. In particular the coupling device is advantageously mounted on the toy railroad car since for a toy railroad due to the comparatively narrow curves and steep slopes great demands are placed on the mobility of the cars coupled with the coupling device.

The coupling body, the drawbar, and the bearing ring are preferably formed as one piece. Thereby the coupling device has few parts, whereby the coupling device is simple in handling and economical in production. Furthermore, the coupling device can thereby be set up simply in a manner suitable for children since no individual small parts which could possibly be swallowed are provided in the coupling device. Rather, the coupling device can be configured robustly so that the coupling device can meet increased demands with regard to the stability as a toy.

The coupling body preferably comprises Neodym which is magnetized transversely to the direction of travel of the cars. The car is, for example, provided with the coupling device at its two longitudinal ends, i.e. front and back. Seen in the direction of travel, for example, for the front coupling device the north pole is located on the left and the south pole on the right and for the back coupling device the south pole is located on the left and the north pole on the right. If two of the cars are moved together and the coupling devices with their contact spines are each brought into contact alternately, then each of the north poles and south poles are opposite one another, whereby the two coupling devices are magnetically attracted. If one of the cars is turned about its vertical axis of the car by 180°, then on the two coupling devices facing one another north poles and south poles are once again opposite one another so that on coupling together of the cars an orientation of the cars in the direction of travel need not be carried out.

Two cars coupled with the aid of the coupling devices can be turned about the vertical axis of the car by means of the bearing. Due to the fact that the pair-wise abutting contact spines can be rolled up on one another, a vertical pivoting of the cars is enabled. By the contact spines of one coupling device being slidable on the contact spines of the other coupling device, the cars can be displaced vertically. This vertical displaceability of the cars is supported by the fact that the bearings can be pivoted about the horizontal axis of the car. On the contact surfaces the coupling devices abutting one another can be displaced transversely, whereby in addition to the turnability of the bearings about the vertical axis of the car a horizontal displacement of the cars relative to one another is enabled.

The bearing play is preferably chosen in such a way that in the uncoupled state the coupling device on the car remains substantially horizontal. Preferably the recess is dimensioned in such a way that the turning of the bearing about the vertical axis of the car is limited so that the longitudinal ends of the coupling body cannot reach up to the central axis of the car. This is advantageous in coupling of two cars since first the longitudinal ends of the coupling body approach one of the longitudinal ends and then after the moving together of the cars approach the longitudinal end of the other side of the coupling bodies.

In the following a preferred embodiment form of the coupling device according to the invention and of the car according to the invention is explained with the aid of the accompanying schematic drawings.

Figure 2:
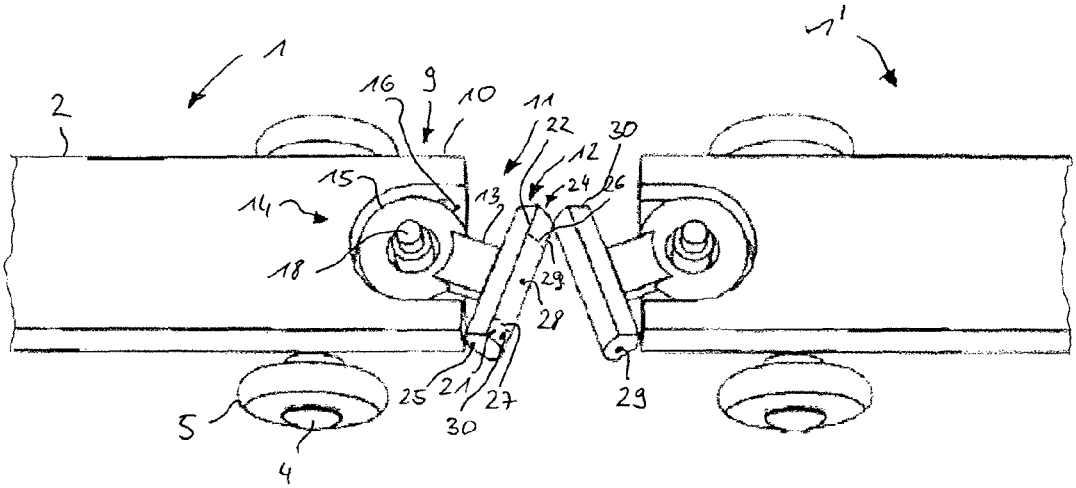
Figure 3:
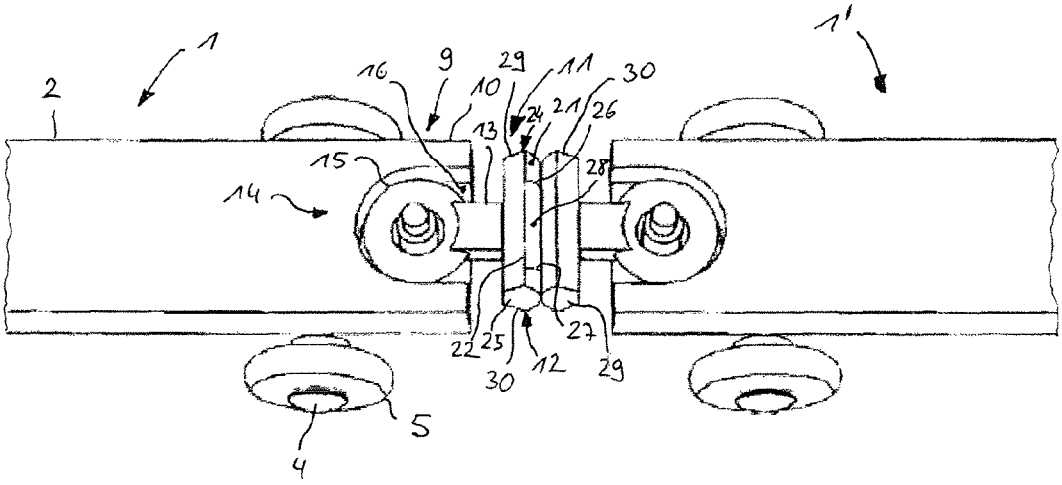

FIG. 1 shows a perspective exploded representation of the car with the coupling device and FIGS. 2 and 3 show a coupling process for two cars.

As can be seen from FIGS. 1 to 3, a car 1 comprises an undercarriage block 2 on which, at the top, an undercarriage plate 3 is disposed. The undercarriage block 2 has an elongated shape, where the undercarriage plate 3 fits flush with the undercarriage block 2. In the area of each of the longitudinal ends of the undercarriage block 2 a wheel axle 4 with wheels 5 is disposed. In FIG. 1 for the left longitudinal end of the car a vertical axis 6 of the car, a longitudinal axis 7 of the car, and a horizontal axis 8 of the car are drawn in. Between the longitudinal end 9 of the car and the wheel axle 4 neighboring it the undercarriage block 2 has a projection 10.

The car 1 is equipped at the longitudinal end 9 of the car with a first coupling device 11 and at the car's longitudinal end disposed facing away from the longitudinal end 9 of the car with a second coupling device. The first coupling device 11 and the second coupling device are in principle embodied with identical construction. The coupling device 11 comprises a coupling body 12, a drawbar 13, and a bearing 14. The coupling body 12 has an elongated shape and extends with its longitudinal axis parallel to the horizontal axis 8 of the car. At the center of the coupling body 12 and facing the undercarriage block 2 the drawbar 13 is fastened, to which in turn a bearing ring 15 of the bearing 14 is fastened. With the drawbar 13 the coupling body 12 is held at a distance from the bearing ring 15. The axis of symmetry of the bearing ring 15 is essentially parallel to the vertical axis 6 of the car, where the bearing ring 15 has a circular cross section. The coupling body 12, the drawbar 13, and the bearing ring 15 are fabricated as one piece.

In the projection 10 of the undercarriage block 2 at the longitudinal end 9 of the car a recess 16 is formed into which the bearing ring 15 can be inserted. At the floor of the recess 16 in the undercarriage block 2 a hole 17 is provided through which a bearing bolt 18 is inserted which in turn is held up in the undercarriage plate 3, where the bearing bolt 18 extends through the bearing ring 15. The bearing bolt 18 has a head 19 for horizontal support on the undercarriage block 2 and a step 20 which is disposed in such a manner that the undercarriage plate 3 lies on the step 20.

The bearing ring 15 lies in a horizontal plane in the recess 16, where the bearing bolt 18 with its longitudinal direction parallel to the vertical axis 6 of the car is in engagement with the bearing ring 15. In the vertical direction the bearing ring 15 is supported in the recess 16, where the bearing ring 15 is mounted so that it can turn about the vertical axis 6 of the car. The play between the bearing ring 15 and the bearing bolt 18 as well as between the bearing ring 15 and the recess 16 is chosen in such a manner that a pivoting movement of the coupling device 11 about the horizontal axis 8 of the car is enabled and said pivoting movement is sufficient for the coupling. Due to the fact that the bearing ring 15 is formed with a circular cross section, i.e. is toroidal, any canting of the bearing ring 15 on pivoting of the coupling body 11 about the horizontal axis 8 of the car is suppressed.

The recess 16 is bounded at the longitudinal end 9 of the car by material of the undercarriage block 2, where the recess 16 is formed in the undercarriage block 2 in such a manner that in extreme pivot positions of the coupling device 11 the drawbar 13 correspondingly abuts the undercarriage block 2.

On a side of the coupling body 12, specifically the side facing away from the bearing 14, the coupling body has a contact face 21 which is formed in the shape of a convex cylinder. The axis of symmetry of the contact face 21 is, when the coupling device 11 is aligned pointing into the longitudinal axis 7 of the car, parallel to the horizontal axis 8 of the car. The contact face 21 is bounded at the top by an upper edge 22 and at the bottom by a lower edge 23, where the upper edge 22 and the lower edge 23 define the vertical extension of the contact face 21. The diameter of curvature of the contact face 21 is less than its vertical extension.

Due to the fact that the coupling body 12 has an elongated shape, it has a first end face 24 and a second end face 25. In the area of the first end face 24 a first contact spine 26 is formed and in the area of the second end face 25 a second contact spine 27 is formed. The contact spines 26, 27 are formed flush with the contact face 21. Between the contact spines 26, 27 an intermediate area 28 of the contact face 21 is established.

The coupling body 12 is formed as a bar magnet, where on the first end face side 24 the north pole 29 and on the second end face side 25 the south pole 30 are established. By the establishment of the poles 29, 30 at the end faces 24, 25 of the coupling body 12 the position of the contact spines 26, 27 is defined.

FIGS. 2 and 3 show the coupling of two cars 1 and 1', each of which is equipped with the coupling device 11. The car 1' is shaped identically to the car 1, where for the car 1 a rear coupling device 11 and for the car 1' a front coupling device are provided if in FIGS. 2 and 3 the direction of travel runs from left to right. In the coupling device 11 of the car 1 the north pole 29 seen in FIGS. 2 and 3 is disposed at the top and the south pole 30 is disposed at the bottom. Analogously for the coupling device of the car 1' the north pole 29 is disposed at the bottom and the south pole 30 is disposed at the top. On moving the cars 1 and 1' together the adjacent unequal poles 29, 30 attract one another, where according to the representation in FIG. 2 the first end face 24 with its north pole 29 contacts the coupling device of the car F. On further moving together of the cars 1 and 1' the second end face 25 approaches the coupling device of the car 1' so that finally the second end face 25 is also in physical contact with the coupling device of the car 1'. Both coupling devices of the cars 1 and 1' are attracted magnetically, where, as shown in FIG. 3, the coupling devices are in the coupled state.

In FIG. 2 the coupling device 11 is in one extreme pivoted position, where the drawbar 13 strikes the undercarriage block 12. The extreme pivoted position is chosen in such a way that on moving together of the cars 1 and 1' the end faces of the two coupling devices facing one another meet and thus the state shown in FIG. 2 is brought into the state shown in FIG. 3. The vertical dimension of the contact faces 21 is chosen by the position of the upper edge 22 and the lower edge 23 in such a way that for the intended and expected traversing of mountains and valleys by the cars 1 and 1' there is always physical contact between the coupling devices. In the coupled state the contact faces of the coupling bodies of the coupling devices of the cars 1 and 1' have a contact line. Due to the fact that the diameter of curvature of the contact face 21 is greater than the distance between the upper edge 22 and the lower edge 23, areas of the contact face 21 of the car 1 which are established neighboring the contact line are disposed comparatively near to their opposing areas of the contact face of the car 1', whereby the magnetic attractive force between the coupling bodies is strong.

The contact face 21 is formed smooth so that reciprocal slipping, either in the vertical direction or in the horizontal direction of the contact faces abutting one another, is enabled. Thus, for example, when a dome is traversed by the cars 1 and 1' the coupling device 11 of the car 1 can be elevated with respect to the coupling device of the car 1', while the physical contact between the contact faces is constantly maintained.

According to another form of embodiment the intermediate area 28 can be made of a non-ferromagnetic material, for example, plastic, where the coupling body 12, at the end faces 24, 25, is made of a magnetic material. In so doing, the magnetization of the end faces 24, 25 is to be chosen in such a way that for coupling devices lying opposite one another, thus as is shown in FIGS. 2 and 3, unequal poles are always opposite one another. According to an additional form of embodiment one of the end faces 24, 25 can be made of a magnetized material, where the other of the end faces 24, 25 is made of a ferromagnetic material. With the two additional forms of embodiment it is also achieved that there is a magnetic attraction of two opposite-lying coupling devices of the cars 1 and 1'. According to an additional form of embodiment it is conceivable that the intermediate area 28 is formed sunken so that the contact spines 26, 27 are formed to be raised.

The invention claimed is:

1. A coupling device comprising:

a coupling body;

a bearing with which the coupling body is mounted to pivot about a vertical axis of a car; and a drawbar via which the coupling body is fastened to the bearing and held at a distance from the bearing, wherein the coupling body comprises at least two convex contact spines, formed horizontally next to one another on a side of the coupling body facing away from the bearing and in a plane parallel to the vertical axis of the car, wherein diameters of curvature of the at least two convex contact spines are greater than an extension of the contact spines in a direction of the vertical axis of the car, wherein at least one of the contact spines is magnetized so that the car couples with another car through magnetic attraction on contact of the contact spines with contact spines of the other car, wherein a side of the coupling body comprises a convex contact face into which the contact spines are integrated, and wherein the convex contact face is vertically curved about the horizontal axis of the car.

2. The coupling device according to claim 1, wherein projections of the contact spines in a direction of the horizontal axis of the car are of a same form and are congruent.

3. The coupling device according to claim 1, wherein the contact spines are formed raised.

4. The coupling device according to claim 1, wherein the contact spines are integrated into the convex contact face such that the contact spines lie flush in the contact face.

5. The coupling device according to claim 4, wherein the contact face is a surface segment of a straight circular cylinder whose axis is perpendicular to the vertical axis of the car.

6. The coupling device according to claim 5, wherein the contact face with its contact spines is formed smooth so that two coupling devices coupled with one another roll up on their contact faces and/or slip against one another in the directions of the vertical axis of the car.

7. The coupling device according to claim 4, wherein the side facing away from the bearing, comprises the convex contact face into which the contact spines are integrated to lie flush in the contact face.

8. The coupling device according to claim 1, wherein the at least two contact spines are formed as a bar magnet, a first magnetic pole of which is established on one of the at least two contact spines, and a second magnetic pole of which is established on another of the at least two contact spines.

9. The coupling device according to claim 1, wherein each of the two contact spines is made of a ferromagnetic material and is ferromagnetically insulated from the other, and wherein one of the two contact spines is magnetized and the other one of the two contact spines is not magnetized.

10. The coupling device according to claim 9, wherein the coupling body comprises an intermediate area which is disposed between the contact spines and which is made of a non-ferromagnetic material, such that the intermediate area magnetically insulates the contact spines from one another.

11. The coupling device according to claim 1, wherein the bearing is arranged such that the coupling body is configured to pivot about the horizontal axis of the car.

12. The coupling device according to claim 11, wherein the bearing comprises a bearing ring and a bearing bolt which, when mounted on the car, extends through the bearing ring with a play sufficiently great that the bearing ring is configured to tilt for pivoting the coupling body on the bearing bolt.

13. The coupling device according to claim 12, wherein the bearing comprises a recess in the car which is dimensioned such that the bearing ring is inserted into the recess with a play sufficiently great that the bearing ring can be tilted for pivoting the coupling body on the bearing bolt.

14. The coupling device according to claim 12, wherein the bearing ring comprises a circular cross section.

15. A car comprising a coupling device according to claim 1, wherein the car is rail-guided.

16. The car according to claim 15, wherein the car is a toy railroad car.

17. The coupling device according to claim 1, wherein each of the at least two contact spines is made of a ferromagnetic material and is ferromagnetically insulated from the other, and wherein the at least two contact spines are oppositely magnetized.

* * * * *